United States Patent [19]

Liljeqvist et al.

[11] Patent Number: 5,038,506

[45] Date of Patent: Aug. 13, 1991

[54] INTEGRATED MODULAR DISPLAY SYSTEM

[75] Inventors: Lance Liljeqvist, Norwalk; Thomas Pendleton, Danbury, both of Conn.

[73] Assignee: Ameritrust Company National Association, Cleveland, Ohio

[21] Appl. No.: 387,281

[22] Filed: Jul. 31, 1989

[51] Int. Cl.[5] ..... G09F 7/02

[52] U.S. Cl. ..... 40/618; 40/611; 40/605; 312/234; 186/37

[58] Field of Search ..... 40/611, 606, 605, 618, 40/624, 620, 152; 108/50; 312/234, 234.1, 234.5; 186/37, 35, 36

[56] References Cited

U.S. PATENT DOCUMENTS

| | | | |
|---|---|---|---|
| 102,196 | 4/1870 | Crotzer | 40/606 |
| 648,421 | 5/1900 | Moore | 40/611 |
| 1,277,869 | 9/1918 | Costley | 40/611 |
| 1,452,873 | 4/1923 | Gifford | 40/606 |
| 1,674,264 | 6/1928 | Prather | 40/611 |
| 2,865,124 | 12/1958 | Mortellito | 40/605 |
| 3,102,351 | 9/1963 | Howell | 40/611 |
| 3,466,777 | 9/1969 | Wistrand | 40/611 |
| 3,636,669 | 1/1972 | Atkisson | 40/605 |
| 4,005,537 | 2/1977 | von Camber | 40/611 |
| 4,533,122 | 8/1985 | Bannister | 256/69 |
| 4,566,211 | 1/1986 | Gustafson | 40/605 |
| 4,642,926 | 2/1987 | Friedman | 40/605 |
| 4,656,766 | 4/1987 | Cooper | 40/605 |

FOREIGN PATENT DOCUMENTS

| | | | |
|---|---|---|---|
| 1563696 | 3/1980 | United Kingdom | 40/605 |
| 8302516 | 7/1983 | World Int. Prop. O. | 40/618 |

*Primary Examiner*—Gary L. Smith
*Assistant Examiner*—F. Saether
*Attorney, Agent, or Firm*—Renner, Otto, Boisselle & Sklar

[57] ABSTRACT

An integrated, modular display system for conveying information in a unified theme is disclosed. The display system comprises a plurality of display panels capable of conveying information, a plurality of frames corresponding in size to the plurality of display panels for receiving at least one of the display panels to support the panels, and a plurality of display bodies for supporting at least one of the frames. The display panels, frames and display bodies are adapted to be combined to form a plurality of individual display units, and a portion of the display panels forming one display unit are interchangeable with a portion of the display panels forming another display unit. In the system, the display panels and frames are provided in groups of several similarly sized display panels and frames.

27 Claims, 4 Drawing Sheets

INTEGRATED MODULAR DISPLAY SYSTEM

FIELD OF THE INVENTION

The present invention is related to merchandizing systems, and more particularly to an integrated modular display system for conveying information in a unified theme.

BACKGROUND OF THE INVENTION

Apparatus and methods for aiding merchants in displaying informational materials concerning products and services have been available in various modes for many years. However, one common problem of known display apparatus and methods is the inability to display information in an organized and economical fashion.

One example of a known apparatus for displaying informational materials is illustrated in U.S. Pat. No. 1,127,223 to Fogle. This patent discloses a display cabinet having a transparent panel on at least one side to allow viewing display cards received within the cabinet. One side edge of the cabinet is removable to allow access to the interior of the cabinet for manipulation of the cards within the cabinet. While the Fogle patent does disclose an apparatus for displaying information with a limited degree of flexibility in the particular materials displayed, the apparatus is severely limited in the manner in which it may be displayed and therefore, it is not economically suited for wide-scale use. Furthermore, the cabinet of the Fogle patent is not disclosed as being a part of an overall merchandizing system and therefore, it does not provide an organized manner in which merchants can promote their goods and services in a variety of modes.

Similarly, U.S. Pat. No. 3,517,905 to Nestegard discloses a free-standing sign holder for supporting removable display cards. As with the apparatus of the Fogle patent, the apparatus of the Nestegard patent is also limited in the manner in which it can be displayed. For example, the sign holder is not readily adaptable for use as a wall display, as well as a standing display. Furthermore, there is no provision for protecting the surface of the display cards when placed within the frames. As a result, the cards are susceptible to damage, thereby precipitating the need for the merchant to replace the cards, thus increasing the cost to the merchant of maintaining the system. Furthermore, the sign holder is not a part of an overall system for conveying information to the consumer in various modes.

More recently, modular display systems have been proposed which allow increased flexibility for merchants. One example is found in U.S. Pat. No. 4,656,766 to Cooper which discloses a panel display system consisting of frames of varying sizes which receive individual display panels. Several frames may be removably interconnected to form a free-standing display presentation by using a specially designed connector or hinge.

One problem with the Cooper system is similar to that of the Nestegard patent, that is, there is no provision for protecting the surface of the display panels when placed within the frames. As a result, the panels are susceptible to damage; precipitating the need for the merchant to replace the panels; and thus increasing the cost to the merchant of maintaining the system. Another problem with the Cooper system lies in the methods disclosed for retaining the display panels within their respective frames. One method attaches the panels with conventional hook-and-loop-type fasteners to an interior edge of the frame. Such fasteners not only have a tendency to lose their adhesive qualities with frequent use, but also have limited strength capabilities and therefore, are not suitable for retaining heavy display panels or artwork. A second method of attaching the display panels involves removing a section of the frame to allow the panel to be slid into a slot formed in the frame. This method is inefficient since it requires disassembly of the display presentation to allow access to the individual frame components. This method requires the system to be rebuilt each time it is desired to change the display panel. Moreover, the Cooper modular display is not a part of an overall system for conveying information to a consumer in various modes. Thus, the Cooper system is neither organized or economical.

It is with these problems of prior display systems that the present invention was developed. The present invention not only overcomes the problems of the above-noted display apparatus, but furthermore, has many advantages not previously achieved in a modular display system.

SUMMARY OF THE INVENTION

The present invention provides an integrated, modular display system for conveying information in a unified theme, comprising a plurality of display panels capable of conveying information, a plurality of frames corresponding in size to the plurality of display panels for receiving at least one of the display panels to support the panels, and a plurality of display bodies for supporting at least one of the frames. The display panels, frames and display bodies are adapted to be combined to form a plurality of individual display units, and a portion of the display panels forming one display unit are interchangeable with a portion of the display panels forming another display unit. In the system, the display panels and frames are provided in groups of several similarly sized display panels and frames.

One of the display units can be a kiosk display unit including a kiosk display body having a front surface and an opposing reverse surface. At least one of the frames is disposed on the front surface and another of the frames is disposed on the reverse surface. A portion of each of said frames are attached to the kiosk display body.

Another of the display units can be a queuing display unit including a queuing display body having a plurality of vertical end supports for supporting the first and second ends of the queuing display body in a horizontal position. The frames are disposed along the front wall of the queuing display body. The queuing display unit can also comprise a center support disposed between the end supports for further supporting said queuing display body.

Another of the display units can be a transaction table display having a transaction table display body for disposition on a horizontal surface. The transaction table display body has a front surface and an opposing reverse surface and the frames are disposed on the transaction table display body on at least one of said front and reverse surfaces.

Another of the display units can be a wall mounted display unit wherein the display body is a fastener for supporting the frames on a vertical surface.

The present invention can also be characterized as a display kit having means for forming a display unit system selected from the group consisting of a wall mounted display unit, a queuing display unit, a kiosk display unit and a transaction table display unit, wherein the means includes a plurality of frames, a plurality of display panels, and at least one display body. Each of the display panels preferably and advantageously includes printed matter capable of conveying information. The frames correspond in size to the display panels and support the display panels. The display bodies support at least one of said frames. A portion of said display panels forming one display unit are interchangeable with a portion of the display panels forming another display unit. The frames and display panels are provided in groups of several similarly sized frames and display panels.

The present invention also comprises a method of making an integrated modular display system, comprising the steps of selecting a plurality of display panels capable of conveying information, selecting a plurality of frames corresponding in size to the plurality of display panels for supporting the display panel, selecting a plurality of display bodies for supporting at least one of the display panels received within one of the frames and combining the display panels, the frames and the display bodies to form a plurality of individual display units, wherein the display panels forming one display unit are interchangeable with display panels forming another display unit. The method may further comprise the step of affixing the frames to the display bodies, removing a portion of one of the frames and removing a portion of the display panel from the frame, removing a portion of another frame and removing a portion of the display panel from the frame, switching the removed portions of the display panels, and replacing the removed portions of each of the frames.

The present invention also comprises an integrated modular display system for conveying a unified theme made by a method comprising the steps of selecting a plurality of display panels capable of conveying information, selecting a plurality of frames corresponding in size to the plurality of display panels for supporting the display panels, selecting a plurality of display bodies for supporting at least one of the display panels received within at least one of the frames, wherein the display panels, the frames and the display bodies are adapted to be combined to form a plurality of individual display units, and wherein the display panels forming one display unit are interchangeable with display panels forming another display unit.

The present invention may also provide a queuing display for orienting customers and for conveying information to customers as they wait in a queue. The queue display has a display body, first and second vertical end supports for supporting first and second ends of the display body to support the display body in a horizontal position, at least one frame disposed along the display body, at least one display panel corresponding in size to the frame and capable of conveying information, wherein the display panel is removably disposed within the frame. The queuing display may further comprise a center support for supporting a center of the display body and at least one frame disposed on each of the vertical end supports. The queuing display body can be formed of aluminum.

The present invention may also comprise a kiosk display for conveying information to customers comprising a kiosk body having a horizontal base supporting a vertically disposed center portion, a plurality of frames disposed on front and reverse surfaces of the center portion; and a plurality of display panels capable of conveying information removably received within the frames, wherein the display panels disposed on the front surface are capable of being interchanged with the display panels disposed on the reverse surface. The kiosk display preferably has at least one of the display panels disposed within the display frames on the front surface. The reverse surface may include pockets for supporting materials. The frame and kiosk body are preferably formed of aluminum.

BRIEF DESCRIPTION OF THE DRAWINGS

The foregoing and other objects, aspects and features of the present invention will be more fully appreciated as the same becomes better understood when considered in conjunction with the detailed description of the present invention viewed in conjunction with the accompanying drawings in which.

DETAILED DESCRIPTION OF THE PREFERRED EMBODIMENTS

Figure 1:
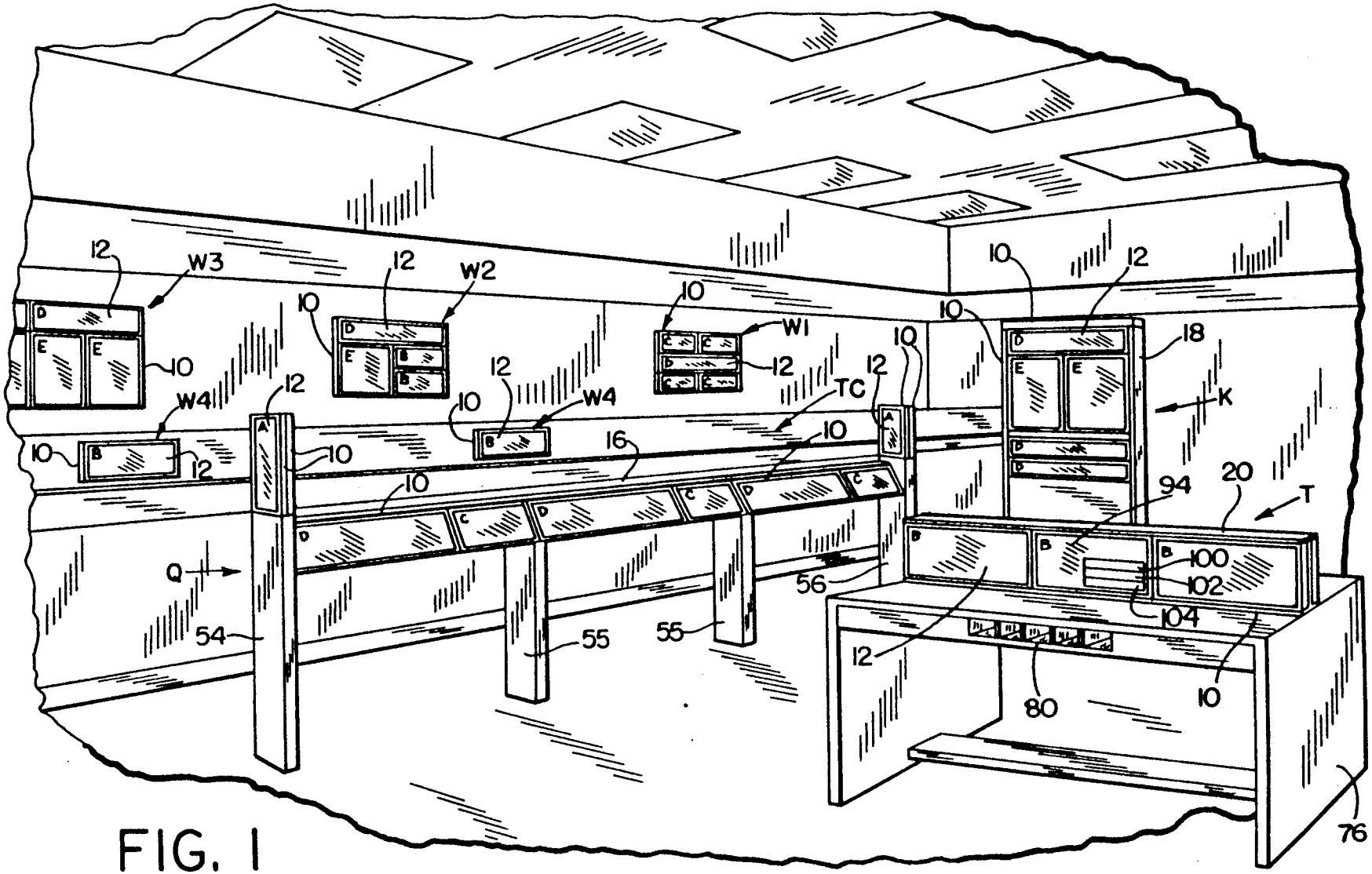
FIG. 1 is a perspective view of a preferred embodiment of the integrated modular display system of the present invention.

Referring now to the drawings, in which similar reference numerals have been used to refer to similar elements, and in particular to FIG. 1, a preferred embodiment of the present invention is shown. The present invention comprises an integrated modular display system for conveying information in a unified theme. The system is both economical and organized in that it allows the display of both permanent and temporary information, while requiring minimal effort by the merchant in order to vary the temporary information materials to fit a particular promotion scheme. By providing display panels which are interchangeble, the system offers the merchant improved flexibility to provide several display units, which are capable of conveying a vast variety of information and which may frequently be changed to meet the particular needs of the merchant and his business, for example, the day, week, month, and season. Another advantage of the present invention is that it is not necessary for the merchant to renovate the interior of his establishment in order to accommodate the display system and to convey a unified merchandizing theme.

Other advantages of the present invention include the ability to be assembled into a variety of individual display units which may then be combined to create the unified merchandizing theme. Once assembled, the system allows interchangeability of display panels incorporating information between the individual display units. The display units themselves are capable of functioning as independent information conveyors and furthermore, can be used to direct consumers within the establishment, such as by providing a substitute for traditional queuing stanchions.

Moreover, when the display units are used in a group, the display units allow the merchant to communicate information to consumers in unified theme. Furthermore, in addition to displaying information in two-dimensional form as display panels, structures for supporting information in the form of brochures and the like may also be received within the present system.

Turning now to the preferred embodiment shown in FIG. 1, the particular system shown is designed for use in a banking institution; a teller counter is shown generally by the letters TC (and forms no part of the present invention). However, the integrated modular display system of the present invention is applicable for use in a variety of settings where it is desirable to convey information to customers in an efficient and organized manner, for example, many retail outlets, as well as food and other service establishments, and the like.

The integrated modular display system of the present invention comprises a plurality of display units, each capable of independently serving as a display unit for conveying information. Each display unit is part of an overall merchandizing system. The display units shown in FIG. 1 comprise: wall mounted display units W (consisting of individual wall mounted display units W1, W2, W3 and W4); a kiosk display unit K; a queuing display unit Q; and a transaction table display unit T. Each of the display units W, K, Q and T will be individually described in more detail below. The particular display units W, K, Q and T have been shown for illustrative purposes only and the present invention should not be limited thereto. Display units of other configurations are contemplated by the present invention so long as they are capable of being integrated with the present system by allowing interchangeability between the information displays of the various display units of the system; that is, that they should provide an organized means for merchants to promote their goods and services in a variety of modes.

Furthermore, while a single display unit of each of the four types mentioned above is shown in FIG. 1, the present invention should not be limited to such as the system could include a plurality of any one or more of the display units. Similarly, the present invention is not limited to providing at least one of each of the display units mentioned. For example, a display system may be comprised of a plurality of any one of the display units (e.g., two queuing display units Q) or could be comprised of one or more, but not all table display units T, one kiosk display unit K, and one queuing display unit Q). As should be clear, the variety and number of display units provided in a single integrated modular display system is practically without limit.

With continuing reference to FIG. 1, it can be seen that disposed on each of the display units (W, K, Q and T) are a plurality of differently sized frames shown generally at 10, supporting correspondingly sized display panels shown generally at 12. Frames 10 are affixed to the display units W, K, Q and T by hardware which is hidden in use by the frame, as will be described in more detail below. By concealing the hardware within the frames 10, the system has a clean and more aesthetic appearance. However, the frames are affixed in such a way that a portion of display panels 12 received therein can be removed or replaced without disturbing the display unit by disassembly or reconstruction.

Frames 10 are an important feature of the present invention as they allow the ready interchangeability of information between display units W, K, Q and T. In the preferred embodiment shown in the drawings, frames 10 are provided in groups of several sized frames, each having defined dimensions which are suitable for disposition on the display units W, K, Q and T. It is not essential that each frame size be suitable for disposition on every display unit, so long as at least two frames in the system are of identical size to allow for the interchangeability of information between the frames.

In the particular embodiment shown in FIG. 1, each of the frames 10 are preferably chosen from the group consisting of frames which are: 10″×7″; 10″×16″; 10″×20″; 10″×40″; and 20″×24″. The number of frames 10 provided in a system is at least that number required to complete the particular display units chosen to be included in the system. The particular system shown in FIG. 1 includes thirty-nine frames.

Each of the display units W, K, Q and T shown in the drawings are comprised of three basic components: 1) a plurality of frames 10; 2) a plurality of individual correspondingly-sized display panels 12, supported in the frames 10; and 3) individual display bodies 14, 16, 18 and 20, to which frames 10 are attached. Each of the three basic components will be described in more detail below.

Figure 4:
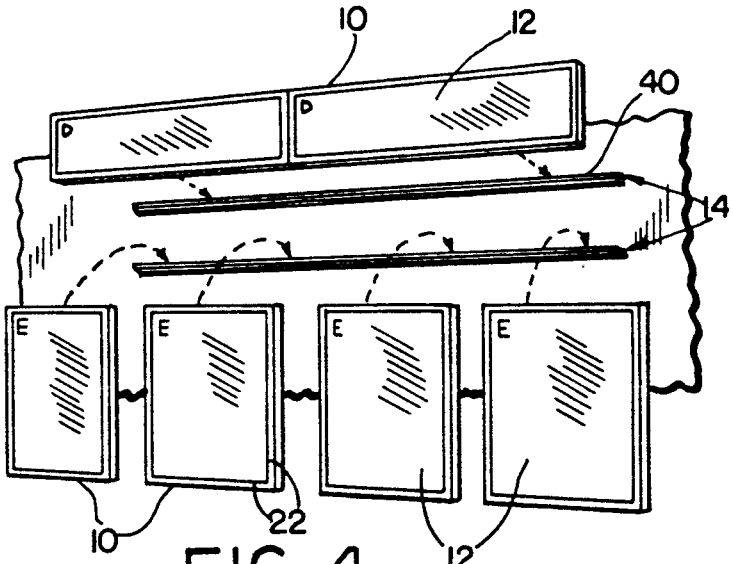
FIG. 4 is a partially exploded view of the wall display unit shown in FIG. 2.

Frame 10 consists of four sides 22, having mitred ends, which are joined together to form a unitary border, similar to a picture frame, for supporting a display panel 12 (see FIG. 4). Tension screws (not shown) may be provided at the corners of sides 22-for stabilizing frame 10. It is desirable that at least one of the sides 22 is removable from the remaining sides to allow easy access to display panel 12 received therein.

Figure 3:
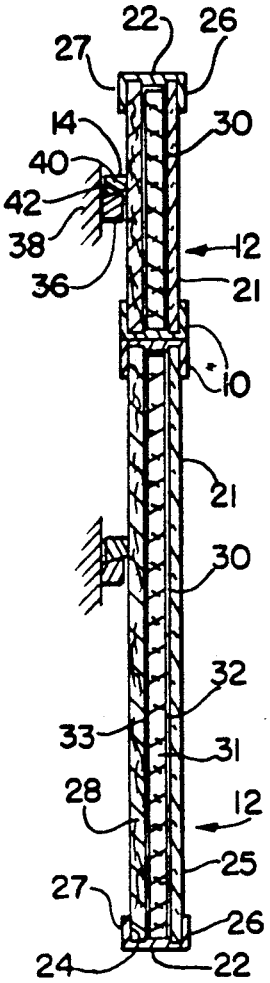
FIG. 3 is a cross-section of the wall display unit, taken along line 3—3 in FIG. 2.

As best shown in FIG. 3, sides 22 of frames 10 each include an interior channel 24 formed by horizontal wall 25 and upstanding peripheral lips 26 and 27 which retain display panel 12 within frame 10. Channel 24 may also serve as a means for attaching frames 10 to several of the display bodies. For example, apertures may be provided along the horizontal side 25 or lip 27 of frame sides 22. Screws or other fasteners placed within channel 24 may extend through the apertures allowing them to be secured to a display body.

The second basic component of the present invention is display panels 12 which are received within frames 10. Similar to frames 10, display panels 12 are provided in groups of similarly sized display panels. In the particular system shown in the drawings, each of the panels 12 are all chosen from the group of panels measuring approximately: 10″×7″(designated by reference letter A); 10″×16″ (designated by reference letter B); 10″×20″ (designated by reference letter C); 10″×40″ (designated by reference letter D); and 20″×24″ (designated by reference letter E). The reference letters A, B, C, D and E are shown in the drawings for the reader's convenience and form no part of the system. The number of display panels 12 necessary for a particular system is at least equal to the number of frames provided.

As best seen in FIG. 3, display panels 12 preferably comprise several layers of panels received within channel 24 of frame 10. These layers are transparent panel 21, layer of artwork 30, rigid board 31, and backing board 28.

Beginning with the layer closest to the customer when display panel 12 is in use, a transparent panel 21 of plastic, such as PLEXIGLAS ®, is provided to protect the layers located behind transparent panel 21, while allowing visibility of such other layers. While transparent layer 2 is not essential to the present invention, it does prolong the life of the artwork by protecting it from unnecessary exposure which can cause damage.

Located immediately behind transparent panel 21 is a layer of artwork 30. Artwork 30 may take many forms, for example it may consist of textual material, pictorial material, or both. There is wide flexibility of the material which may be displayed in that any known means for creating a tangible medium of expression can be used to form artwork 30. Artwork 30 is shown in FIG. 3 as being formed of a thin layer adhered to or otherwise secured to a front surface 32 of a rigid board 31. However, where the artwork is formed of a self-supporting medium, one having sufficient thickness, rigid board 31 may be omitted. When omitted, storage space for artwork not currently in use is provided between the visible artwork layer 30 and the rigid backing board 28 located behind the visible artwork. The side of artwork 30 carrying information to be conveyed is visible through transparent panel 21. For added versatility of the system, artwork may be provided on both front surface 32 and rear surface 33 of rigid board 31, allowing each layer of artwork to be displayed in two different manners. The number of panels of artwork 30 is at least equal to the number of frames provided in the system. However, it is likely that additional artwork may be provided for added versatility of the system. Furthermore, it is expected that the artwork may continue to be generated and even replaced as the system is in use to meet the needs of particular promotional schemes of the merchant. As a result, frames 10 remain affixed to their respective display bodies (to be discussed in detail below), while at least a portion of display panel 12, such as artwork 30, may be removed from its associated frame, through one of the sides 22 of the frame. It may be replaced by another layer of artwork as desired. The artwork is replaced by sliding one artwork layer out and another artwork layer in.

Located behind artwork 30 and rigid board 31 is rigid backing board 28 which helps maintain the stability of display panel 12 and also fills the space remaining in channel 24 between artwork 30 and peripheral lip 27 of sides 22. If it is desirable to provide a display panel which is visible from both sides of its associated frame, a second transparent panel could be substituted for backing board 28, and a second layer of artwork, with its information conveying surface facing the second transparent layer, would also be provided.

Referring back to FIG. 1 the wall mounted display unit W will now be described. FIG. 1 shows four different embodiments of wall mounted display units W ($W_1$, $W_2$, $W_3$ and $W_4$), in accordance with the present invention. The common feature among all of the wall mounted display units W (as with all the other display units K, Q and T), is that they are each comprised of a plurality of frames 10, a plurality of display panels 12 and a display body. In the case of the wall mounted display unit W, the display body is wall mounted display body 14 (FIGS. 3 and 4).

In particular, wall mounted display body 14 comprises a cleat consisting of a wall mounted portion 36, which is attached to a wall 38 or other vertical surface; and a frame mounted portion 40, attached to backing board 28 of display panel 12. Wall mounted portion 36 and frame mounted portion 40 have compatible diagonally sloping surfaces 42 which when mated, cooperate to suspend display panels 12 within frames 10 on wall 38. That is, in use, mounted portion 40 is supported by gravity on wall mounted portion 36 because there no interaction between portions 36 and 40 other than portion 40 resting on portion 36. This particular arrangement allows frame 10 to be easily removed from wall 38 without disturbing wall mounted portion 36 or requiring any tools or special skills.

In addition to the wall mounted display body 14 shown in FIGS. 3 and 4, any known mechanical fasteners commonly used for supporting materials on a vertical surface may be used. However, it is advantageous to the operation of the system of the present invention that the particular wall mounted display body chosen allow the frames to be easily removed from the vertical surface for changing the contents received therein.

One example of an alternate structure to support frames 10 are two element hook-and-loop type fasteners one element of the fastener would be affixed to the wall 38 or other vertical surface, while the other element would be affixed to backing board 28.

Furthermore, where the wall mounted display unit W may be susceptible to accidental bumping, such as the wall mounted displays W4 at the teller counter TC, such displays may be secured to the teller counter TC by screws or other fasteners placed within channel 24 and extending through apertures (not shown) in lip 27, as described above with regard to frame sides 22. Where this method is used to secure frames 10 to a vertical surface, one of the frames sides 22 should remain unaffixed so that it is removable for access to the display panels supported therein. For the teller counter wall mounted display units W4, it is preferable that the top or side panels of the frame be removable for ease of access.

Figure 5:
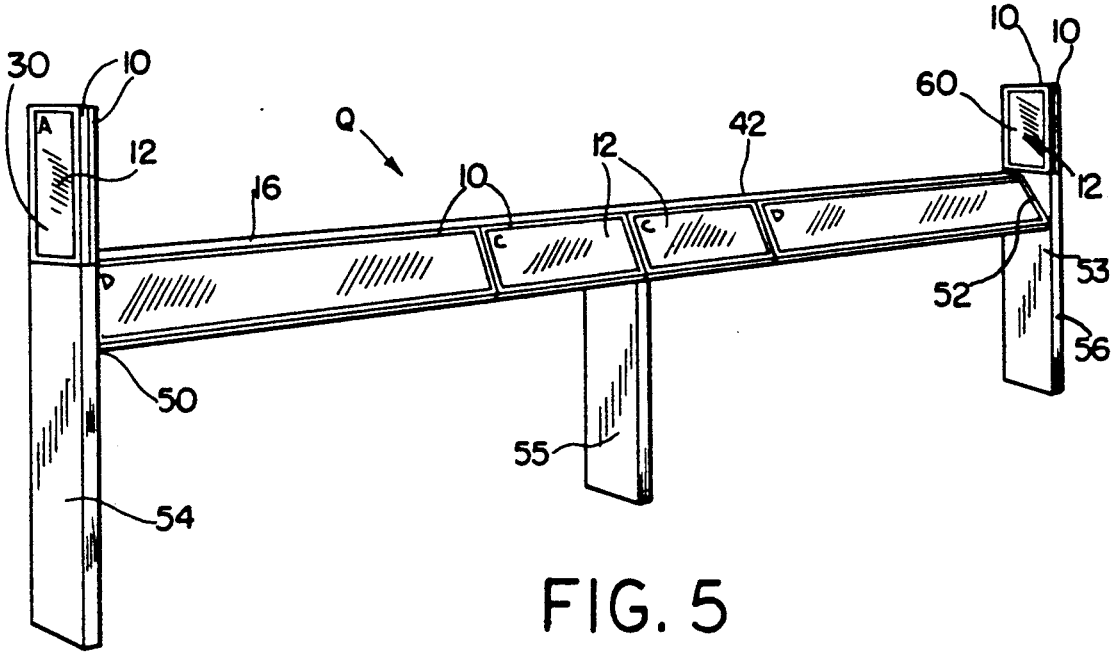
FIG. 5 is a close-up perspective view of one embodiment of a queuing display unit, similar to that shown in FIG. 1.
Figure 6:
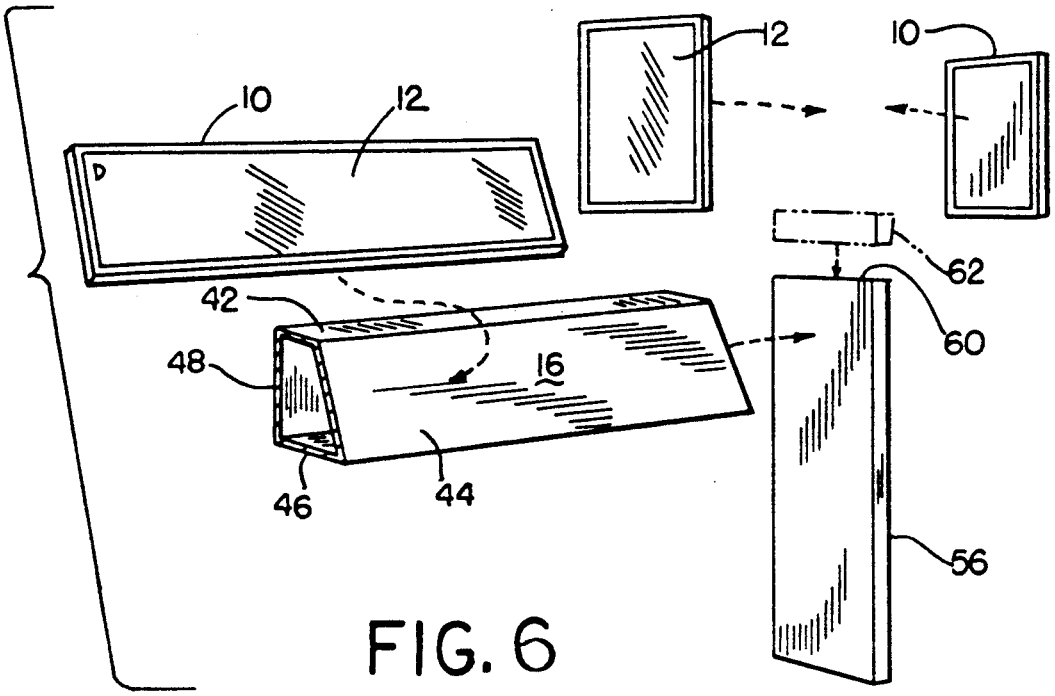
FIG. 6 is a partially exploded view of a portion of the queuing display unit shown in FIG. 5.

Turning now to the queuing display unit Q, shown in FIGS. 1, 5 and 6, this display unit is quite unique in that it aids customers in forming a line or queue while they await service by tellers, for example, at the teller counter TC. In this respect, queuing display unit Q serves as a replacement for traditional stanchions (i.e. several waist-high vertical columns joined by ropes) commonly used to form a queue. The advantages of the queuing display unit Q over conventional stanchions, lie not only in the more attractive appearance of the queuing display unit Q, but also in that it provides education for the consumer while waiting in line. Such education is provided by display panels 12, supported within frames 10, disposed on a queuing display body 16.

As shown in more detail in FIGS. 5 and 6, queuing display unit Q consists of three basic components: 1) frames 10; 2) display panels 12; and 3) queuing display body 16. Frames 10 and display panels 12 are identical to those discussed above with regard to the wall mounted displays W. Queuing display body 16 is provided in a hollow parallelogram configuration, consisting of walls 42, 44, 46 and 48 (FIG. 6). In its most preferred form, queuing display body 16 is formed of extruded aluminum or suitable plastic material (similar to the material forming frames 10). Apertures (not shown) may be provided along front wall 44, in particular, of queuing display body 16 to reduce the weight thereof.

One alternative structure of queuing display body would be to eliminate walls 46 and 48, leaving walls 42 and 44. Additionally, geometric configurations other than the parallelogram shown are possible for constructing queuing display body 16.

In the embodiments shown in the drawings, queuing display body 16 is provided in 60" (inch) segments. The queuing display unit Q shown in FIG. 1 is comprised of three 60" segments and the queuing display unit Q shown in FIG. 5 is comprised of two 60" segments. It is possible to form a queuing display with only a single segment or more than two segments, as well as to provide the segment(s) in lengths other than 60". When two or more segments are used, they may be joined to one another by any known means, for example bolts or welding.

Each queuing display body 16 includes a first end 50 and a second end 52 (FIG. 5). A first vertical end support 4, and a second vertical end support 56 are provided to support first end 50 and second end 52, respectively, thus supporting queuing display body 16 in a horizontal position. Preferably, first and second vertical end supports 54, 56 are hollow and are formed of extruded aluminum, however, as with the queuing body 16, any suitable plastic or other material exhibiting sufficient strength characteristics may be used.

First end 50 and second end 52 of queuing display body 16 are provided with vertical end plates (not shown) which close off the ends of queuing display body 16 allowing it to be attached (bolted, welded or otherwise secured) to side walls 53 of first and second vertical end supports 54, 56. When two or more 60" segments of the queuing display body 16 are provided in a single queuing display unit Q, a vertical center support 55, similar in construction to vertical end supports 54 and 56 although not as tall, is preferably provided underneath the seam at which the segments are joined. As shown in FIG. 1, where three 60" segments are joined, two vertical center supports 55 are provided; similarly, in FIG. 5 where two 60" segments are joined, a single vertical center support 55 is provided.

Referring back to FIG. 6, frames 10 for supporting display panels 12 are disposed on front wall 44 of queuing display body 16. Wall 44 is preferably angled for optimum visibility by a person waiting in line adjacent the queuing display unit Q. However, it is not essential that wall 44 be so angled, that is, wall 44 may, for example, be vertical if so desired. Furthermore, frames 10 may alternately be provided on wall 42 or wall 48 or any combination of walls 42, 44 and 48, if so desired.

Securement of frames 10 to queuing display body 16 is preferably by screws or bolts provided within channel 24 of the frames that pass through an aperture provided in lip 27 of the frame which is then secured to queuing display body 16. The fasteners are preferably not exposed to view, thus creating a more visually attractive display. Obviously, other ways to secure frame 10 to queuing display 16 can be utilized so long as they perform the function of secure fastening to prevent accidental removal. One of the sides 22 of each frame 10, preferably the top side, remains unaffixed and removable, to allow access to each display panel 12 located within its respective frame 10.

In addition to providing frames 10 along wall 44 of display body 16, frames 10 may also be provided on the top surface 60 of end supports 54 and 56 (FIG. 6). The artwork 30 within each frame 10 atop end support 54 may for example, provide the message "EXIT", while the artwork 30 within each frame 10 atop end support 56 may provide the message "ENTER". These frames may be attached to end support surface 60 by any known attaching means, such as bolts or screws, as with the frames attached to wall 44.

If preferred, rather than provide frames 10 atop edge 60, an end mount 62 (shown in phantom in FIG. 6), may be provided. End mount may be formed of any suitable material such as aluminum or plastic, and is fitted within the hollow interior of each end support 54, 56 so that it lies flush with the top edge 60 of the same to provide a finished look.

In use of the queuing display unit Q shown in FIG. 1, a customer approaches the queuing display unit Q from the right side or side closest to wall 44 and the display panels 12. The first person in the queue stands with the left side of their body adjacent wall 44 and facing second vertical end support 56. Subsequent customers enter the queue by positioning themselves like the first customer. The first customer steps out of the queue and approaches the teller counter TC, by walking around second vertical end support 56 and is then positioned between the teller counter TC and wall 48 of the queuing display body 16. In situations where it may be desirable to provide additional queuing capabilities, a second queuing display unit Q may be provided in parallel with the one shown in FIG. 1, so that the queue may "snake" or double back upon itself for additional queuing management. Conventional stanchions may also be provided to add additional queuing capabilities to the queuing display unit Q.

Figure 7:
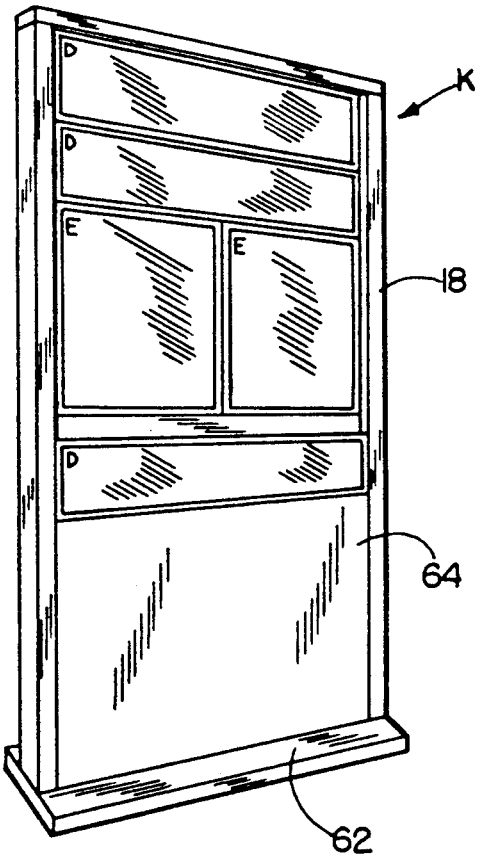
FIG. 7 is a close-up perspective view of one embodiment of a kiosk display unit similar to that shown in FIG. 1.
Figure 8:
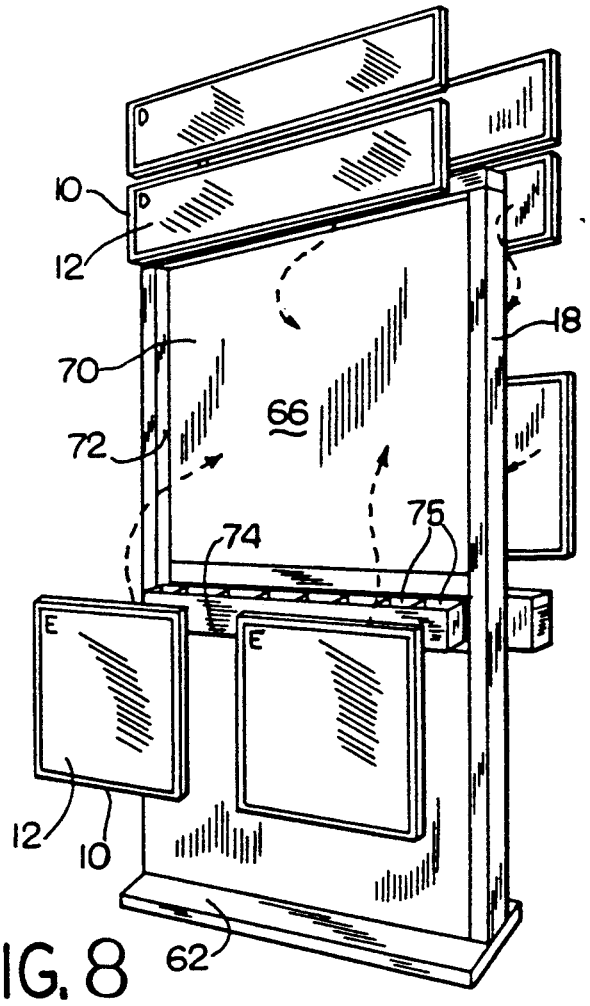
FIG. 8 is a partially exploded view of the kiosk display unit having a rack.

Turning now to the kiosk display unit K shown generally in FIGS. 1, 7 and 8, one advantage of the kiosk display unit K of the preferred embodiment is that it is visible from at least two sides (best seen in FIG. 8). (In alternate embodiments, it is visible on one side.) Referring now more particularly to FIGS. 7 and 8, kiosk display unit K comprises three basic components: 1) frames 10; 2) display panels 12: and 3) a kiosk display body 18. Frames 10 and display panels 12 are identical to those already discussed above with regard to the wall mounted display units W and the queuing display unit Q.

Kiosk display body 18, like queuing display body 16, is preferably made of extruded aluminum or other suitable material such as plastic having sufficient strength characteristics. Kiosk display body 18 may be provided as a single unit or may be comprised of several components joined to one another to form kiosk display body 18. More specifically, kiosk display body 18 is comprised of a generally horizontal base 62 which supports a vertically disposed center portion 64. Self-leveling feet, as are known in the art, may be provided on base 62 to steady the Kiosk display body 18 on the floor of the business establishment in which it is used. Center portion 64 includes a front surface 66, and a reverse surface (not shown), both of which includes a recess 70 for receiving frames 10. Each recess 70 is defined by upstanding interior peripheral walls 72 and in one embodiment is 40" across (width) center portion 64 and 50" in length. Frames 10 are disposed within each recess 70 and are affixed to interior walls 72 by any suitable means, for example screws or bolts, by fitting them within channel 24, as discussed above, so that the fasteners are hidden from view. As many as three sides 22 of each frame 10 may be affixed to interior walls 72 of recess 70 to support frames 10. However, at least one side should remain unaffixed and removable, in order to allow access to each display panel 12 located within each of the frames 10. Therefore, when it is desirable to change the artwork located within a particular frame 10, the nonaffixed side of the frame is pulled away from surface 66 to allow the unaffixed side to be removed from the frame and thereby, access to the display panel 12. Frames 10 may be arranged within recess 70 in a variety of configurations, as demonstrated by the different arrangement shown in FIG. 1 and in FIG. 7, for example.

An additional feature of the invention which may be provided on kiosk display unit K, is shown in FIG. 8, and is the provision of a brochure rack 74. Rack 74 is fitted within a frame 10 which is attached to kiosk display body 18 in the manner described above. Brochure rack 74 may be made of transparent material, similar to panel 21, and includes any number of pockets 75 extending from and disposed across the front surface of the brochure rack 74. Pockets 75 are preferably 5" wide by 1½" deep, and are suitable for holding brochures and the like. While non-transparent material may be used to form brochure rack 74, one advantage of using transparent material is that artwork 30 disposed behind the rack will remain visible.

We now turn to transaction table display unit T (FIGS. 9 and 10), which is also comprised of three basic components: 1) frames 10; 2) display panels 12; and 3) a transaction table display body 20. Frames 10 and display panels 12 are identical to the those discussed above with regard to the wall mounted display units W, queuing display unit Q, and kiosk display unit K.

Figure 9:
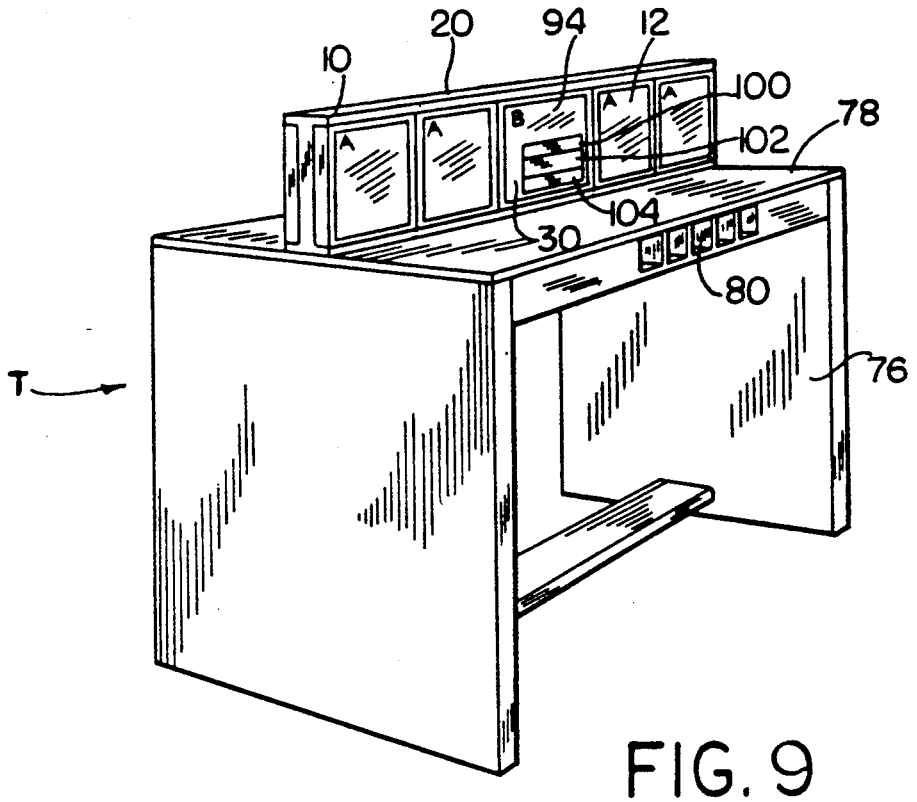
FIG. 9 is a close-up perspective view of one embodiment of a transaction table display unit similar to that shown in FIG. 1.
Figure 10:
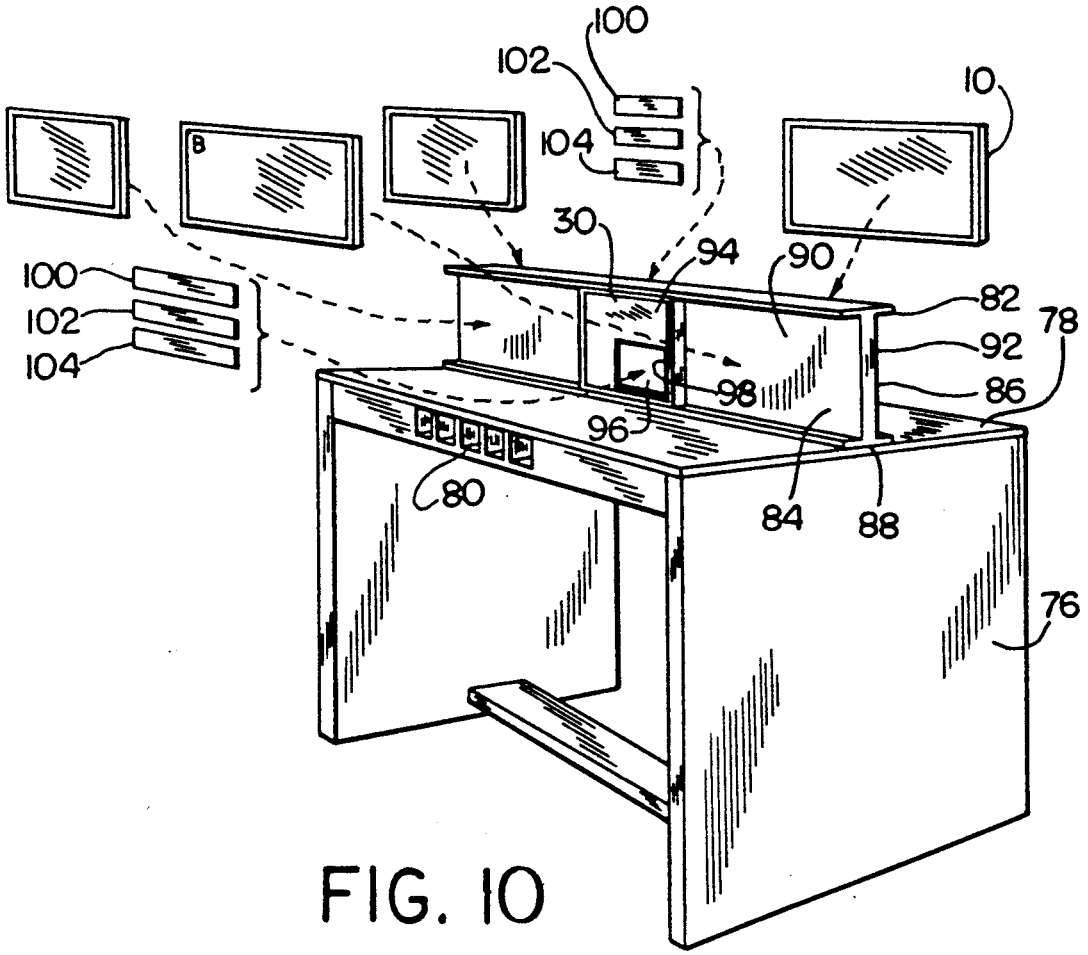
FIG. 10 is a partially exploded view of the transaction table display unit shown in FIG. 1.

Transaction table display unit T is shown in FIGS. 1, 9 and 10, and includes a transaction table 76, which includes a horizontal surface 78 for supporting a portion of transaction table display body 20. While a particular transaction table 76 has been shown in the drawings, any suitable structure providing a horizontal surface may be utilized with the present invention. Transaction form holders 80 are also shown on transaction table 76.

Transaction table display body 20 is generally an elongated "I", preferably formed of extruded aluminum, or other suitable material such as that forming frames 10, queuing display body 16, and kiosk display body 18. Transaction table display body 20 may be of any suitable length and width to meet the needs of the particular table, and is secured by any suitable means, for example screws or adhesive to horizontal surface 78.

With continuing reference to FIG. 10, transaction table display body 20 comprises a top portion 82, a front vertical surface 84, a rear vertical surface 86, and a bottom portion 88. Bottom portion 88 is disposed on horizontal surface 78 of transaction table 76. Top portion 82, front vertical surface 84 and bottom portion 88 form a first recess 90 for receiving frames 10. Similarly, top portion 82, rear vertical surface 86, and bottom portion 88 form a second recess 92 also for receiving frames 10. Frames 10 are secured to top portion 82 and/or bottom portion 88 by any suitable fasteners, for example screws or bolts, by positioning the fasteners within apertures located along lip 27 of frame 10 thereby fastening the frame to front vertical surface 84 and rear vertical surface 86 within recesses 90 and 92 respectively. At least one side 22, of frame 10 should remain un-affixed to allow access to display panel 12 received within the frame 10.

The center display panel 94 of the transaction table display unit is slightly different than panels 12 previously described, in that panel 94 provides means for displaying the particular day, date and month of the year and for allowing such information to be frequently and conveniently changed. In particular, display panel 94 is similar to panels 12 in that a rigid backing board and artwork are provided. However, rather than being affixed to a rigid board, the artwork 30 is affixed to a metal (for example, steel) board 96.

Artwork 30 of panel 94 includes a rectangular cutout 98 which exposes metal backing board 96 (see FIG. 10). Reusable magnetic panels 100, 102 and 104 are provided which in combination, correspond in size to rectangular cutout 98. Magnetic panels 100 are preferably provided in a group of seven, each corresponding to a particular day of the week. Similarly, magnetic panels 102 are provided in a group of twelve, each one corresponding to a particular month of the year; while magnetic panels 104 are provided in a group of 31, each corresponding to the dates in a month. A transparent plastic panel need not be provided on display panel 94 in order to allow frequent (i.e., daily) changing of magnetic panels 100, 102, and 104 if necessary. Furthermore, display panels similar to panel 94 are not limited to use on the transaction table display units and can be used on the wall mounted display units W, the queuing display unit Q and the kiosk display unit K.

Referring generally to the integrated modular display system of the present invention, one feature is the variety of frames 10 which may be combined with the individual display bodies 4, 6, and 2 to form display units W, Q, K and T respectively; as well as the interchangeability of artwork 30 among the frames 10 of the various display units W, K, Q and T.

Figure 2:
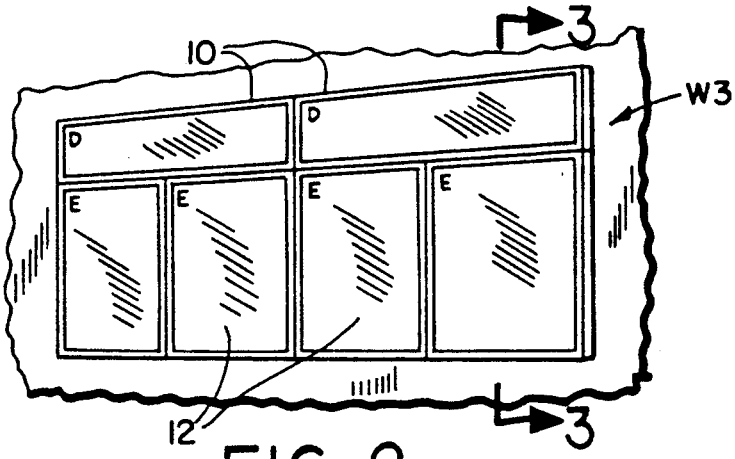
FIG. 2 is a close-up perspective view of one embodiment of a wall display unit shown in FIG. 1.

In particular, any one or more of the five frame panel sizes (10"×7" (A); 10"×16" (B); 10"×20" (C); 10"×40" (D); and 10"×24" (E)) may be used to form a wall mounted display unit W. This feature is best shown in FIG. 1 wherein wall mounted display unit $W_1$ is comprised of four 10"×20" frames/panels C and one 10"×40" frame/panel D. Wall mounted display $W_2$ is comprised of one 10"×40" frame/panel D, one 20"×24" frame/panel E, and two 10"×16" frame/panels B. Wall mounted display unit $W_3$, a portion of which is shown in FIG. 1, and the entire unit being shown in FIGS. 2 and 4, is comprised of two 10"×40" frame/panels D and four 20"×24" frame/panels E. Wall mounted display unit $W_4$ is comprised of a single 10"×16" frame/panel B.

The queuing display unit Q shown in FIG. 1 is comprised of three 40"×10" frame/panels D and three 10"×20" frame/panels C. In contrast, the queuing display unit shown in FIG. 5 is comprised of two 10"×40" frame/panels D and two 10"×20" frame/panels C. Frames 10 disposed on the end supports 54 and 56 of the queuing display unit Q preferably are comprised of two 10"×7" frames/panels A.

Each side of the kiosk display unit K, shown in FIGS. 1 and 7, is comprised of three 10"×40" frame/panels D and two 20"×24" frame/panels E. Each side of the kiosk display unit K in FIG. 8 shows three 10"×40" frame/panels D (one of which is comprised of brochure rack 74), and two 20"×24" frame/panels E.

Transaction table display unit T shown in FIGS. 1 and 10 are comprised of three 10"×16" frame/panels B; while the transaction table display unit T shown in FIG.

9 is comprised of four 10"×7" frame/panels A at either end, and a center 10"×16" frame/panel B.

Because of the similarity of size among frames/panels A, B, C, D and E, which make up the integrated modular display system, it is possible to interchange similarly sized artwork 30 received within the frames/panels A, B, C, D and E among the various display units W, Q, K and T, thus allowing wide flexibility among the system and the particular information conveyed.

In particular, artwork 30 received within a 10"×16" frame/panel B (for example, wall mounted display unit $W_1$) can be exchanged (switched) with any other artwork 30 received within another 10"×16" frame/panel B (for example, wall mounted display unit $W_2$). Similarly, artwork 30 received within a 10"×20" frame/panel C or a 10"×40" frame/panel D (for example, queuing display unit Q and kiosk display unit K) is exchangeable with another 10"×20" frame/panel C or 10"×40" frame/panel D (for example wall unit $W_2$).

This interchangeability provides for vast flexibility among the information conveyed in the display system, thus allowing the merchant to periodically change the information conveyed by rearranging the artwork. The amount of artwork available for use with the system should not be limited to the number of frames available in the system. Rather, additional artwork may also be provided to increase the variety of information that may be conveyed. Furthermore, some of the artwork may be permanent, such as artwork 30 of display panel 94, while other artwork is interchangeable, such as magnetic panels 100, 102 and 104.

In addition to that described above, additional features of the present invention are also possible. Such additional features include, for example, a lighted display panel made by using a flexible light sheet (PAPER LIGHT TM) available from Systems Display International, Beaverton, Oregon. Such light sheets are highly flexible, and very thin and may be provided behind transparent artwork for example, fitted within the frames 10. Accessibility to a power source, for example a battery or electrical outlet, would be necessary.

In addition to the lighted display panels, game board display panels could also be provided to allow interaction between the customer and the display system. Such display panels would include a preprinted circuit board behind interchangeable artwork, thus allowing customers to test their knowledge by answering questions printed on the artwork. The circuitry would indicate when the right answer has been touched by the customer. Such preprinted game boards are known in the art, and do not form apart of the present invention.

In addition, pockets could be provided along wall 42 of queuing display body 16, and top portion 82 of transaction table display body 20 to hold for example, brochures and other literature, as well as pens or other writing instruments.

While the present invention has been described above with regard to the overall integrated modular display system, the present invention may also be characterized a display kit for forming a display unit system. Such a system is selected from the group consisting of a wall mounted display unit W, a kiosk display unit K, a queuing display unit Q and a transaction table display unit T. Furthermore, each of the above units would comprise at least one frame, supporting a correspondingly sized display panel, and supported on a display body. One of the advantages of such a kit is that it could be made available to the consumer for creating a display system within a business establishment without requiring the merchant to renovate the interior of the establishment. Furthermore, it is a complete kit in that all of the matching components necessary for constructing the integrated modular display system (i.e. frames, display panels and display bodies) are provided to the consumer, allowing increased economical efficiency and organization.

In addition, the present invention may also be characterized as a method of making an integrated modular display system. Such a method comprises the steps of selecting a plurality of display panels 12, selecting a plurality of frames 10 corresponding in size to the display panels 12 and selecting a plurality of display bodies (14, 16, 18 and 20) for supporting at least one of the display panels 12 received within a frame 10. The display panels 12, frames 10 and bodies 14, 16, 18 and 20 are adapted to be combined to form a plurality of individual display units W, Q, K and T. Furthermore, display panels 12 forming one display unit W, Q, K and T are interchangeable with display panels 12 forming another display unit.

It should be understood that the foregoing disclosure relates only to presently preferred embodiments, and that it is intended to cover all changes and modifications of the invention herein chosen for the purpose of the disclosure which do not constitute departures from the spirit and scope of the invention as set forth in the appended claims.

We claim:

1. An integrated, modular display system for conveying information in a unified theme, comprising a plurality of display panels each capable of conveying information, a plurality of frames corresponding in size to said plurality of display panels for supporting said plurality of display panels, each of said frames receiving at least one of said display panels, a plurality of different display bodies for supporting at least one of said frames, means for attaching said frames to said display bodies, said display panels, said frames and said display bodies being adapted to be combined to form a plurality of individual display units, said frames including a frame portion that is removable while said frames are attached to said display bodies to permit insertion and removal of said display panels from said display units, said display panels forming one of said display units being interchangeable with said display panels forming another of said display units the interchangeable display panels being in the same size.

2. A system, as set forth in claim 1, wherein said display panels and said frames are provided in groups of several correspondingly sized display panels and frames.

3. A system, as set forth in claim 1, wherein there are a plurality of different sized frames supporting correspondingly sized display panels attached to a plurality of said display bodies that are interchangeable.

4. A system, as set forth in claim 1, wherein said frames include interior channels for receipt of at least one of said display panels.

5. A system, as set forth in claim 4, wherein said channels are of a sufficient width to provide storage space for additional display panels not currently in use.

6. A system, as set forth in claim 1, wherein at least one of said display panels has information on opposite sides for displaying either of said sides in said frames.

7. A system, as set forth in claim 1, wherein at least some of said display panels have information thereon which is visible from opposite sides of at least one of said frames when attached to at least one of said display bodies.

8. A system, as set forth in claim 1, wherein at least one of said display units is a kiosk display unit including a kiosk display body having a generally horizontal base and a vertically disposed center portion supported by said base, said center portion having a front surface and an opposing reverse surface, at least one of said frames being attached to said front surface and another of said frames being attached to said reverse surface.

9. A system, as set forth in claim 8, wherein said front and reverse surfaces include recesses for receiving said frames.

10. A system, as set forth in claim 9, wherein a plurality of said display panels and said frames are provided in each of said recesses on said front and reverse surfaces in groups of several correspondingly sized display panels and frames.

11. A system, as set forth in claim 10, wherein at least one of said display panels forming said kiosk display unit are interchangeable with another of said display panels forming another of said display units.

12. A system, asset forth in claim 1, wherein at least one of said display units is a queuing display unit including a queuing display body having a first end, an opposing second end, and a front wall, and a plurality of vertical end supports for supporting said queuing display body in a horizontal position at said first end and said second end, at least one of said frames being disposed along said front wall.

13. A system, as set forth in claim 12, wherein said front wall is angled for optimum visibility of a plurality of said display panels supported by a plurality of said frames on said front wall by a person waiting in line adjacent said queuing display unit.

14. A system, as set forth in claim 12, wherein other of said frames are mounted on a top surface of said vertical and supports with said other of said frames extending vertically above said front wall in substantial vertical alignment with said vertical end supports.

15. A system, as set forth in claim 12, wherein said queuing display unit further comprises a center support disposed between said end supports for further supporting said queuing display body.

16. A system, as set forth in claim 1, wherein at least one of said display units is a transaction table display unit including a horizontal surface and a transaction table display body disposed on said horizontal surface, said transaction table display body having a front vertical surface and an opposing reverse vertical surface, at least one of said frames being disposed on at least one of said front and reverse surfaces.

17. A system, as set forth in claim 16, wherein said front and reverse surfaces are recessed to receive a plurality of said frames.

18. A system, as set forth in claim 17, wherein at least one of said display panels supported by one of said frames mounted on one of said front and reverse surfaces includes a rectangular cutout exposing a metal backing board for magnetically attaching a plurality of changeable magnetic panels which in combination correspond in size and shape to said rectangular cutout.

19. A display kit comprising means for forming a display unit system including a plurality of different display units selected from the group consisting of a wall mounted display unit, a queuing display unit, a kiosk display unit and a transaction table display unit, wherein said means includes a plurality of frames, a plurality of display panels, and a plurality of display bodies, each of said display panels includes printed matter for conveying information, said frames correspond in size to said display panels and support said display panels, and said display bodies support at least one of said frames, said frames including a frame portion that is removable while said frames are attached to said display bodies to permit insertion and removal of said display panels from said display units, at least one of said display panels forming one of said display units being interchangeable with another of said display panels forming another of said display units the interchangeable display panels being the same size.

20. A display kit, as set forth in claim 19, wherein said frames and display panels are provided in groups of several correspondingly sized frames and display panels.

21. A display kit, as set forth in claim 19, wherein said kiosk display unit comprises a kiosk display body having a front surface and an opposing reverse surface, at least one of said frames being disposed on said front surface and at least another of said frames being disposed on said reverse surface, said frames being attached to said front and reverse surfaces along a portion of each of said frames.

22. A display kit, as set forth in claim 19, wherein said queuing display unit comprises a queuing display body having a first end, an opposing second end, and a front wall, a plurality of vertical end supports for supporting said queuing display body in a horizontal position at said first and second ends, a plurality of said frames being disposed along said front wall of said queuing display body.

23. A display kit, as set forth in claim 22, wherein said front wall is angled for optimum visibility of a plurality of said display panels supported by a plurality of said frames on said front wall by a person waiting in line adjacent said queuing display unit.

24. A display kit, as set forth in claim 22, wherein other of said frames are mounted on a top surface of said vertical end supports with said other of said frames extending vertically above said front wall in substantial vertical alignment with said vertical end supports.

25. A display kit, as set forth in claim 19, wherein said transaction table display unit comprises a horizontal surface, and a transaction table display body disposed on said horizontal surface, said transaction table display body having a front surface and an opposing reverse surface to which a plurality of said frames are attached.

26. A display kit, as set forth in claim 19, wherein said wall mounted display unit comprises a wall mounted display body disposed on a vertical surface, at least one of said frames being supported on said wall mounted display body.

27. A method of making an integrated modular display system, comprising the steps of selecting a plurality of different display panels each capable of conveying information, selecting a plurality of frames corresponding in size to said plurality of display panels for supporting said display panels, selecting a plurality of display bodies for supporting said plurality of display panels received within said frames, combining said display panels, said frames and said display bodies to form a plurality of individual display units with said frames affixed to said display bodies, said display panels forming one of said display units being interchangeable with said display panels forming another of said display units where the interchangeable display panels are the same size, said frames including a frame portion that is removable while said frames are affixed to said display bodies to permit insertion and removal of said display panels from said frames, removing said frame portion of at least two of said frames and removing said display panels from said two of said frames, switching said display panels of said two of said frames, and replacing such frame portions of said two of said frames.

* * * * *